United States Patent [19]

Bird et al.

[11] Patent Number: 4,582,546

[45] Date of Patent: Apr. 15, 1986

[54] METHOD OF PRETREATING COLD ROLLED SHEET TO MINIMIZE ANNEALING STICKERS

[75] Inventors: James E. Bird; Colin B. Hamilton, both of Monroeville; Robert M. Hudson, Pittsburgh, all of Pa.

[73] Assignee: United States Steel Corporation, Pittsburgh, Pa.

[21] Appl. No.: 745,376

[22] Filed: Jun. 17, 1985

Related U.S. Application Data

[63] Continuation of Ser. No. 592,736, Mar. 26, 1984, abandoned, which is a continuation of Ser. No. 378,047, May 14, 1982, abandoned.

[51] Int. Cl.[4] ..... C21D 1/00

[52] U.S. Cl. ..... 148/14; 148/12 R; 148/12 C; 148/12 D; 148/18; 134/2; 134/40; 204/141.5; 204/145 R

[58] Field of Search ..... 204/141.5, 145 R; 134/2, 40; 148/12 C, 14, 18, 12 R

[56] References Cited

U.S. PATENT DOCUMENTS

| | | | |
|---|---|---|---|
| 3,796,645 | 3/1974 | Fujita et al. | 204/145 R |
| 3,919,000 | 11/1975 | Yarrington | 148/14 |
| 3,950,572 | 4/1976 | Ayusawa et al. | 148/12 R |
| 4,035,256 | 7/1977 | Brendlinger et al. | 204/141.5 |
| 4,120,702 | 10/1978 | Akerblom | 148/113 |

FOREIGN PATENT DOCUMENTS

| | | | |
|---|---|---|---|
| 9398 | 1/1981 | Japan | 204/145 |
| 69388 | 6/1981 | Japan | 148/12 D |

OTHER PUBLICATIONS

*Lange's Handbook of Chemistry,* Twelfth Edition, McGraw-Hill Book Co., N.Y., 1979, pp. 2-27.

*Primary Examiner*—Veronica O'Keefe
*Attorney, Agent, or Firm*—Arthur J. Grief

[57] ABSTRACT

In the box annealing of steel sheet, the tendency for adjacent wraps of the sheet to pressure weld (stick) is decreased or eliminated by passing the sheet, prior to annealing, through a rinse containing from 1,500 to 10,000 ppm of the magnesium or calcium salts of soluble carboxylic acids—preferably formates. Further benefits are realized if the sheet is electro-cleaned with a silicate containing cleaning solution, and thereafter rinsed in the formate solution whereby the latter acts to fix the concentration of silicates remaining on the surface of the sheet.

8 Claims, No Drawings

METHOD OF PRETREATING COLD ROLLED SHEET TO MINIMIZE ANNEALING STICKERS

This application is a continuation of Ser. No. 592,736 filed Mar. 26, 1984 which was a continuation of Ser. No. 378,047 filed May 14, 1982, both abandoned.

The heat treatment of cold-reduced steel sheet and strip is accomplished either in batch operations or in continuous operations. Batch heat treatment may be divided into two categories: (a) open-coil annealing in which a tight coil is first rewound with a suitable spacer in between each wrap of the coil to permit circulation of the furnace atmosphere between the individual wraps to hasten and improve the uniformity of heating, and (b) box annealing in which a large stationary mass of steel (either cut sheet or coils) is subjected to a comparatively longer heat treatment cycle by varying the temperature within the furnace that surrounds it. In the latter, box annealing practices, the mass of steel is slowly raised to the desired annealing temperature and soaked at such temperature for a period of ½ to 24 hours. The use of such a practice provides full recrystallization of severely cold-reduced steel and results in the softest possible finished product. However, one draw-back to such practice is the tendency of the individual wraps of sheet, because of their tightly wound nature, to pressure weld or stick together when held at annealing temperature for extended lengths of time—the tendency to sticking increasing with pressure between the wraps and the time and temperature of the anneal. When sticking of adjacent coil wraps occurs, particularly in products with critical surface finish requirements, poor yields result. Additionally, production delays are encountered at the temper mill because lower rolling speeds are required or because recoiling may be necessary before further processing. To prevent such sticking, the prior art has resorted to the use of a variety of separating mediums such as colloidal solutions of alumina or silica (J Pat. No. 54-99,730), finely divided magnesium oxide particles (GER. Pat. No. 1,408,930) and the formation of thin oxidizing films on the metal surface (J Pat. No. 51-57,610). The latter reference also shows that the use of silicate containing washing liquids aids in preventing sticking—a practice which has been recommended for many years by manufacturers of commercial cleaning compounds. Although many steel facilities use silicated cleaners, such use has not precluded the serious incidence of coil sticking. It has now been found, that if subsequent to electrolytic alkaline cleaning, the steel surface is subjected to a rinse with an aqueous solution containing 1,500 to 10,000 ppm of a carboxylic acid salt of calcium or magnesium and thereafter allowed to dry so as to leave a residue of the carboxylic acid salt on the surface, that the incidence of sticking may be materially reduced. As an added benefit, it has also been found that such preanneal rinses are effective in minimizing SUFT (Surface Unsuitable for Tinning).

These and other advantages of the instant invention will become more apparent from a reading of the following description when taken into conjunction with the appended claims.

Prior to the invention hereof, a laboratory procedure had been developed to obtain a quantitative measurement of the sticking tendency of sheet during box annealing, and which measurements were found to correlate quite well with actual mill experience. Investigations were conducted using different types of steel, both continuous cast and ingot cast steels, since the prior art (i.e., Lvov and Goldstein, STAL, Volume 1, No. 1, page 78, 1941) had suggested that steel composition, particularly carbon and phosphorus, had an effect on sticking. Compositions of two of the ingot cast steels evaluated are listed in Table I, below.

TABLE I

| Compositions of Full-Hard Steels | | |
|---|---|---|
| Element | "A" | "B" |
| C | 0.110 | 0.10 |
| Mn | 0.388 | 0.42 |
| P | 0.007 | 0.007 |
| S | 0.024 | 0.023 |
| Si | 0.012 | 0.019 |
| Cu | 0.014 | 0.038 |
| Ni | 0.016 | 0.011 |
| Cr | 0.029 | 0.026 |
| Mo | 0.006 | 0.011 |
| Al | 0.002 | 0.002 |
| N | 0.004 | 0.004 |

Steel panels were cut to a size of 2¾"×8". After vapor decreasing, the panels were subjected to electrolytic alkaline cleaning in various solutions (indicated in Table II) maintained at a temperature of 82° C., at a current density of 10.8 amps/dm$^2$ for a period of one second (either cathodic or anodic). After electrolytic cleaning, the panels were passed through rubber wringer rolls to remove excess cleaning solution. Rinse water at a temperature of 54°–60° C. was sprayed on the steel surface to wash off the remaining cleaner and the panels were then dried to remove unbound water.

Four 1"×2" coupons were cut from each cleaned and rinsed panel to provide 24 coupons to be assembled in a test pack—each pack consisting of 12 paired test specimens, with each pair separated by a stainless steel spacer. To simulate the pressure exerted by the wrapping of coils, a 15.2 lb. weight was used for each run. The test pack was placed in a sealed stainless steel annealing box containing a protective atmosphere of 6% $H_2$—94% $N_2$ with a dew point controlled to minus 40° C. by passing the gas mixture through a column of calcium sulfate. The annealing box was placed in a furnace and heated to an annealing temperature of 1250° F. in two hours. After a three hour soak period at said annealing temperature, the furnace was cooled rapidly. Test packs were removed after the annealing box was cut open and individual tension-shear test specimen pairs were placed in a tension tester and pulled apart. The amount of force required to pull the samples apart is then utilized as a quantitative measure of the degree of sticking that occurred during annealing. For each group of 12 specimens, the average sticking force and the variance were calculated. Each average value is reported in Table II with a 95% confidence interval.

Utilizing the above test procedures, previous experiments with silicated cleaners (not utilizing the rinse additives of the instant invention) had shown that significantly lower sticking force values resulted when final strip polarity was cathodic—a difference which was not observed when non-silicated cleaners were applied. In this regard, even when final strip polarity was anodic, lower sticking force values resulted from the use of silicated cleaners. Such results had suggested a mechanism relating to surface composition, which might involve the presence of silicates or other residue (e.g. thermal decomposition products of various constituents of the rinse water) playing a part in reducing sticking, wherein the concentration of such residues would be increased by a final cathodic pass. This was borne out by a comparative test in which sticking tendency, utilizing deionized water vs. the normally employed mill water was used in the final rinse—the latter exhibited a significant decrease in sticking force. Since mill water is known to be made hard primarily because of magnesium and calcium ions, a number of rinse additives—containing soluble salts of magnesium and calcium were evaluated to determine if the cations of such salts would also be a factor vis-a-vis sticking tendency. When used at a concentration of 3,000 ppm in the rinse, manganese sulfate, calcium phosphate, and magnesium sulfate did not significantly change sticking force values from those resulting when hard mill water was applied. However, the formates and acetates of calcium and magnesium did provide significant changes of sticking force, and the results of same are reported in Table II below.

TABLE II

| Laboratory Sticking Experiments | | | | |
|---|---|---|---|---|
| Rinse Condition No. | Electrolytically Cleaned | Rinse After Cleaning | Sticking Force, Lbs. Strip Cathodic | Sticking Force, Lbs. Strip Anodic |
| | | Steel "A" | | |
| 1 | No | None | 568 ± 21 | |
| 2 | Yes | Deionized water | 468 ± 30 | 535 ± 20 |
| 3 | Yes(1) | Hard mill water | 476 ± 21 | 455 ± 16 |
| 4 | Yes | Hard mill water | 359 ± 40 | 569 ± 36 |
| 5 | Yes | $Mg(HCOO)_2$, 979 ppm | 338 ± 23 | 460 ± 61 |
| 6 | Yes | $Mg(HCOO)_2$, 3855 ppm | 124 ± 19 | 217 ± 17 |
| 7 | Yes | $Mg(HCOO)_2$, 5871 ppm | 96 ± 16 | 144 ± 24 |
| 8 | Yes(1) | $Mg(HCOO)_2$, 5871 ppm | 241 ± 34 | 305 ± 21 |
| 9 | Yes | $Ca(HCOO)_2$, 1942 ppm | 341 ± 29 | 423 ± 57 |
| 10 | Yes | $Ca(HCOO)_2$, 3787 ppm | 252 ± 39 | 275 ± 33 |
| 11 | Yes | $Ca(HCOO)_2$, 5826 ppm | 131 ± 33 | 199 ± 32 |
| 12 | Yes | (1) Hard mill water (2) 1942 ppm $Ca(HCOO)_2$ | 265 ± 16 | 438 ± 19 |
| 13 | Yes | (1) Hard mill water (2) 3884 ppm $Ca(HCOO)_2$ | 222 ± 42 | 275 ± 33 |
| 14 | Yes | $Mg(HCOO)_2$, 1957 ppm + $Ca(HCOO)_2$, 1942 ppm | 273 ± 28 | 270 ± 17 |
| 15 | Yes | $Mg(CH_3COO)_2$, 3000 ppm | 272 ± 40 | 447 ± 43 |
| | | Steel "B" | | |
| 16 | None | None | 488 ± 9 | |
| 17 | Yes | Deionized water | 346 ± 24 | 450 ± 6 |
| 18 | Yes | $Ca(HCOO)_2$, 5000 ppm | 206 ± 17 | 261 ± 17 |
| 19 | Yes | $Mg(CH_3COO)_2$, 5000 ppm | 165 ± 30 | |
| 20 | Yes | $Ca(CH_3COO)_2$, 5000 ppm | 289 ± 22 | |

(1)Except as indicated, all specimens were electro-cleaned utilizing a commercial silicated cleaner. For conditions 3 and 8, electro-cleaning was with a commercial phosphated cleaner.

It may be seen from the above, that when used in concentrations of 1,500 to 10,000 ppm, generally 3,000 to 8,000 ppm, and more preferably 4,000 to 6,000 ppm, the formates and acetates of magnesium and calcium can significantly improve sticking force values, irrespective of strip polarity. Use of such rinse solutions will normally result in a dried-on residue concentration of 0.3 to 2.0 mg/ft$^2$. Such residue concentration will, of course, be a function of rinse solution concentration, but will also depend on the thickness of the drag-out film remaining on the strip—which thickness is a function of the strip speed and wringer-roll pressure. Preferably, the residue concentration of said carboxylic acid salts will be within the range 0.5 to 1.2 mg/ft$^2$. Although most tests were carried out with a silicated cleaner, the results show that even with a non-silicated cleaner (e.g. Condition 8), a measurable improvement in sticking force followed use of an effective rinse additive, such as magnesium formate.

In most of the above tests, solutions containing rinse additives were used immediately after electrolytic cleaning. On commercial lines with scrubber section that require large volumes of water, a two-stage practice may be required to reduce chemical costs. Evaluations were therefore conducted (Conditions 12 and 13) simulating use of a two-stage rinse. The results show that a final rinse (subsequent to a mill water rinse) containing the additives of the instant invention is also effective in lowering sticking.

It would therefore appear, while the complete mechanism relating to surface composition and sticking cannot yet be established, that certain soluble salts of magnesium and calcium used as rinse additives appear to fix silicon on the steel surface, over and above the silicon level resulting when either deionized water or hard mill water is used. Cathodic cleaning appears to fix more silicon than does anodic cleaning. With non-silicated cleaners containing phosphate, cleaning polarity does not appear to be quite as important a variable. Nevertheless, both previous results and those reported above, demonstrate that sticking in the absence of silicates can also be lowered by the use of dried-on calcium or magnesium formates that degrade during annealing. Thus, while silicate levels on clean steel surfaces are important in their effect on sticking during annealing, the fact that a final rinse with an "appropriate" additive was effective even after an initial rinse in hard water, suggests that silicates, phosphates, and the thermal degradation products of calcium and magnesium formates and acetates all contribute to lower sticking during box annealing, as compared with a steel that does not have these residues on the surface.

We claim:

1. In the method for the box-annealing of a coil of steel sheet wherein said sheet is electrolytically cleaned in a cleaning solution consisting of silicate or phosphate cleaners, or mixtures thereof, passed through a rinse solution at a speed of 1,000 to 3,000 ft./min., coiled and thereafter heated to an annealing temperature of 1,050° to 1,400° F. in a non-oxidizing atmosphere and soaked at such temperature for a time of at least one-half hour, whereby said annealing tends to result in the sticking together of adjacent sheets of said mass, the improvement for reducing the tendency of said sheets to stick together, wherein the solution utilized for said rinse consists essentially of salts selected from the group consisting of calcium formate, magnesium formate, calcium acetate, magnesium acetate, or mixtures thereof, in a total concentration of said salts of from 3,000 to 8,000 ppm, and the drag out film remaining on the sheet is controlled such that after drying, the residue concentration of said salts will be within the range 0.3 to 2.0 mg./ft.$^2$.

2. The method of claim 1, wherein subsequent to the rinse, the drying is continued to remove essentially all the unbound water of the residue remaining on the surface of the sheet, and the concentration of said salts is within the range 4,000 to 6,000 ppm.

3. The method of claim 1, in which said cleaner solutions contains silicates and said sheet travels in the cleaner solution through a plurality of electrode pairs, in which during the passage of such sheet through the last electrode pair, the sheet is made cathodic.

4. The method of claim 1, in which said salts are the formates.

5. The method of claim 1, wherein the dried sheet has a concentration of 0.5 to 1.2 mg/ft$^2$ of said salts on the surface thereof.

6. In the method for the box-annealing of a mass of cold-reduced steel sheet wherein said sheet is electrolytically cleaned in a cleaning solution consisting of silicate or phosphate cleaners, or mixtures thereof, rinsed, dried, coiled and thereafter heated to an annealing temperature in a non-oxidizing atmosphere and soaked at such temperature for a time of at least one-half hour, whereby said annealing tends to result in the sticking together of adjacent sheets of said mass, the improvement for reducing the tendency of said sheets to stock together, wherein the solution utilized for said rinse contains salts selected from the group consisting of magnesium formate, magnesium acetate, or mixtures thereof, in a total concentration of said salts of from 1,500 to 10,000 ppm.

7. The method of claim 6, wherein subsequent to the rinse, the drying is continued to remove essentially all the unbound water of the residue remaining on the surface of the sheet, and the concentration of said salts is within the range 3,000 to 8,000 ppm.

8. The method of claim 4, in which said salt is calcium formate.

* * * * *